US006023255A

United States Patent [19]

Bell

[11] Patent Number: 6,023,255

[45] Date of Patent: Feb. 8, 2000

[54] PRESENTING IMAGES TO AN OBSERVER

[76] Inventor: Bill Bell, 139 Davis Ave., Brookline, Mass. 02146

[21] Appl. No.: 08/907,654

[22] Filed: Aug. 8, 1997

[51] Int. Cl.[7] ..... G09G 3/20

[52] U.S. Cl. ..... 345/46; 345/31

[58] Field of Search ..... 345/113, 114, 345/123–125, 138, 46, 31, 44, 56, 82, 189; 340/76, 324 R, 334, 726, 768, 792, 825.81; 364/401; 434/157; 178/7.3 D

[56] References Cited

U.S. PATENT DOCUMENTS

| | | | |
|---|---|---|---|
| 882,555 | 3/1908 | Doane . | |
| 3,493,956 | 2/1970 | Andrews et al. | 340/334 |
| 3,566,388 | 2/1971 | Andrews et al. | 340/334 |
| 3,623,070 | 11/1971 | Johnson et al. | 340/339 |
| 3,638,215 | 1/1972 | Payne | 340/234 R |
| 3,651,511 | 3/1972 | Andrews et al. | 340/324 R |
| 3,763,468 | 10/1973 | Ovshinsky et al. | 340/825.81 |
| 3,937,878 | 2/1976 | Judice | 178/7.3 D |
| 4,162,493 | 7/1979 | Ross et al. | 340/760 |
| 4,205,312 | 5/1980 | Nelson | 340/792 |
| 4,284,988 | 8/1981 | Seitz et al. | 340/726 |
| 4,386,351 | 5/1983 | Lowdenslager | 340/768 |
| 4,470,044 | 9/1984 | Bell | 340/755 |
| 4,631,516 | 12/1986 | Clinker | 346/76 |
| 4,882,724 | 11/1989 | Vela et al. | 346/401 |
| 5,027,112 | 6/1991 | Rose et al. | 340/792 |
| 5,145,375 | 9/1992 | Rubio | 434/157 |
| 5,215,466 | 6/1993 | Rubio | 434/157 |
| 5,630,068 | 5/1997 | Vela et al. | 395/201 |
| 5,767,822 | 6/1998 | Hiroshi | 345/46 |

*Primary Examiner*—Matthew Luu
*Assistant Examiner*—Jeff Piziali
*Attorney, Agent, or Firm*—Fish & Richardson P.C.

[57] ABSTRACT

Images are presented to an observer using a controllable light delivery medium having a display region. The light delivery medium is controlled in such a way as to enable the observer to perceive any of more than one image based on the motion state of the observer's eye and without relying on any change in the operation of the controller or the medium as the basis for triggering the perception of the more than one image.

49 Claims, 18 Drawing Sheets

PRESENTING IMAGES TO AN OBSERVER

BACKGROUND

The invention relates to presenting images to an observer.

Advertising images, for example, are sometimes presented on a grid of lights that are turned on or off in patterns. Such images can be made to appear to move, for example, in the manner used on the well-known traveling-message sign in Times Square in New York.

Others have suggested altering such a sign by decimating selected columns of the lights. The moving text could then still be perceived if the speed of motion of the text were chosen correctly. On such a decimated display, an observer would see either flickering, stationary columns or the moving text, depending on whether the observer's gaze were fixed or were tracking the moving text.

In a similar way, an observer can perceive the complete image of a large sign on a truck that is moving behind a picket fence even though only portions of the sign are visible at any moment. The persistency capability of human vision that enables the observer to perceive the message.

SUMMARY

In general, the invention features apparatus (and a related method) for presenting images to an observer. A light delivery medium extending in at least two dimensions bears a field of light delivery areas that are independently modulatable. The respective light delivery areas are modulated in a succession of different patterns that are presented rapidly enough to invoke the persistence capability of the observer's vision, enabling the observer to perceive a first image in the field of light delivery areas. The field of light delivery areas are arranged so that as the different patterns are presented, a second, different image may be perceived by the observer in the same region in which the first image may be perceived.

Implementations of the invention may include one or more of the following features. The field of light delivery areas may be stationary. The modulation may be done by a device that includes a sheet of material on which the first image is formed. The light delivery areas may be arranged on a sheet of material in the form of the second image. The first image and the second image may be perceived to be in motion relative to one another with, e.g., the second image stationary and the first image in motion. The observer may perceive either the first image or the second image depending on the motion state of the observer's eye. The perception of at least one of the images may depend on motion of the observer's eye to track motion of the image. The first and second images may be perceived as a result of the persistence capability of the eye. Neither of the first and second images may be perceivable from any one of the different patterns.

The light delivery areas may be also modulated in a manner to provide visual cues that aid the observer in perceiving at least one of the images. The visual cues may include tracking cues that aid the observer's eye in tracking motion of one of the images; or a visual element that is displayed along a border of the field and moves at the same rate and in close proximity to the moving image; or a constantly displayed element on the field of light delivery areas, e.g., a frame along the border of the field; or an inversion of the modulation to increase the amount of light generated by the light delivery areas for the second image; or a region of enhanced contrast.

The light delivery areas may be arranged on a rectangular grid which is not fully populated by the light delivery areas.

The light delivery areas may be arranged on the field to represent the second image. The light delivery areas may comprise light sources, e.g., LEDs or pixels on a computer screen. The modulation may be done by a programmed computer or by a circuit. The light delivery medium could be a traveling-message display. The modulation may be done between on and off states or among more than two levels of intensity or between different colors. At least one of the images may include text or a graphical element.

Among the advantages of the invention are one or more of the following: It provides an easy to generate, amusing, eye-catching, and eye-challenging display. Multiple images can be displayed at the same place at essentially the same time. The observer's attention is easily drawn to the device, thus enhancing the effectiveness of traveling message displays. The invention would be useful in a wide variety of applications, including advertising, computer display schemes, novelties, art objects, and games.

Other advantages and features will become apparent from the following description and from the claims.

DETAILED DESCRIPTION

FIG. 1 is a front view of an image mask and a moving image.

FIGS. 2 and 3*a* through 3*f* are front views of the image mask overlaid on the moving image at successive times.

FIGS. 8, 9 and 10*a* through 10*f* are front views illustrating motion cues.

Figure 11:
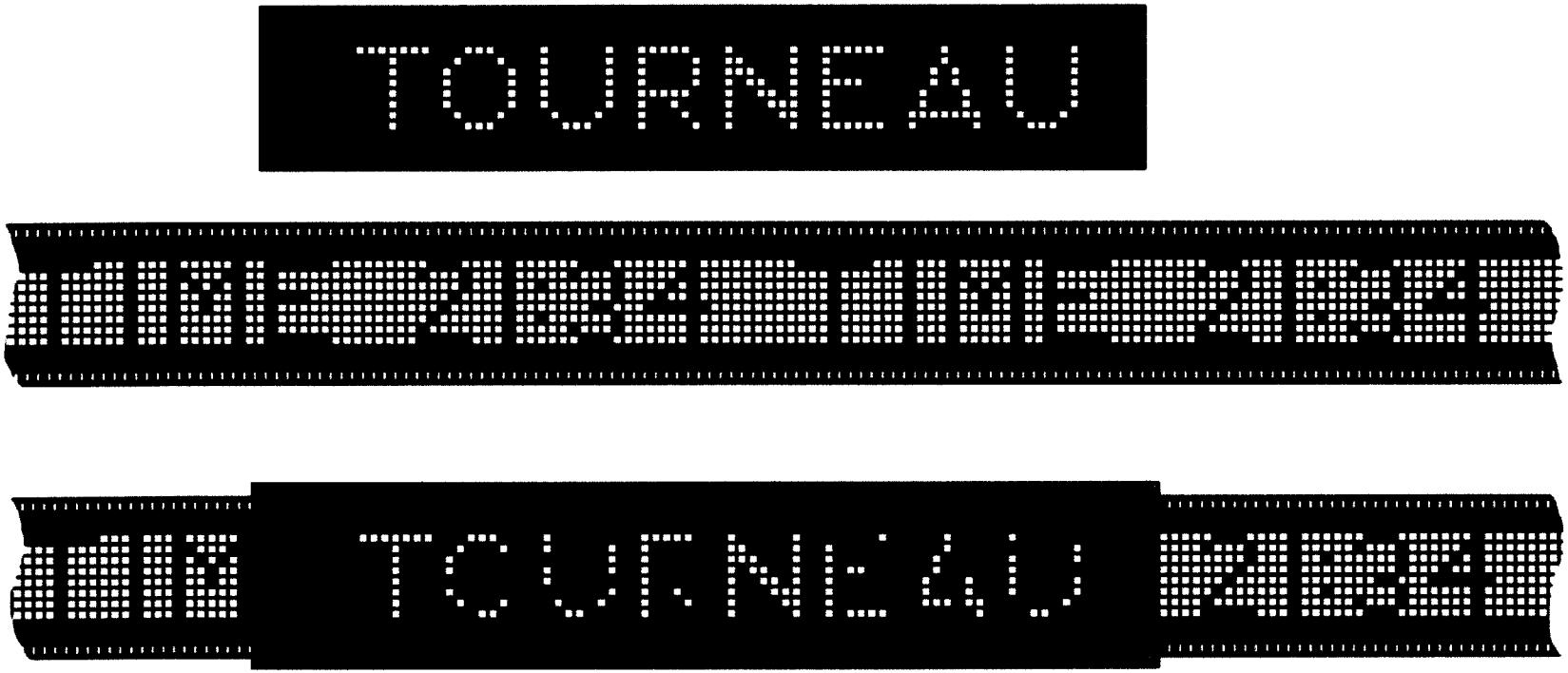

FIG. 11 is a front view of an inverted moving image.

FIGS. 12 and 13*a* through 13*f* are front views showing both a motion cue and two levels of brightness.

Figure 14:
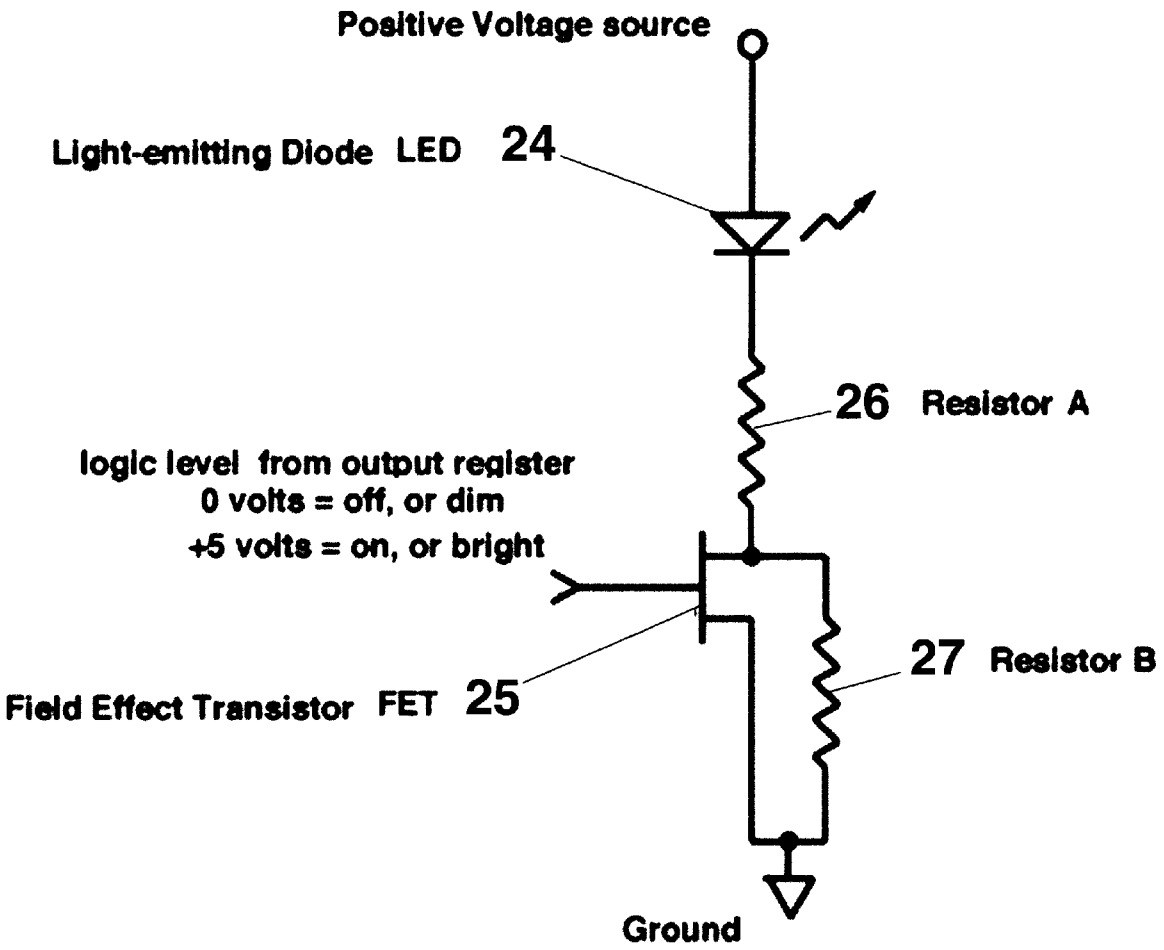
Figure 15:
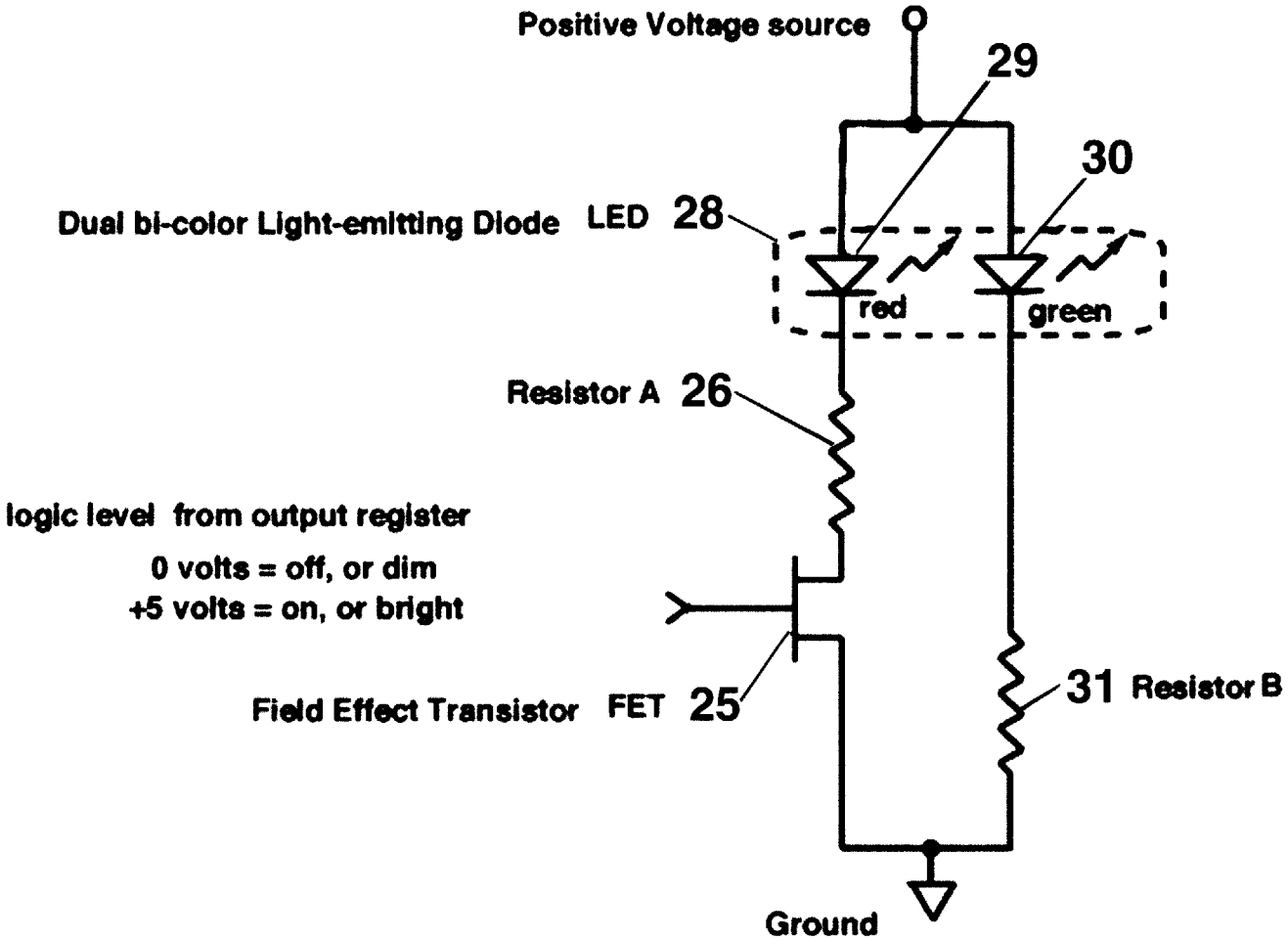

FIGS. 14 and 15 are circuit diagrams of LED drivers.

Figure 16:
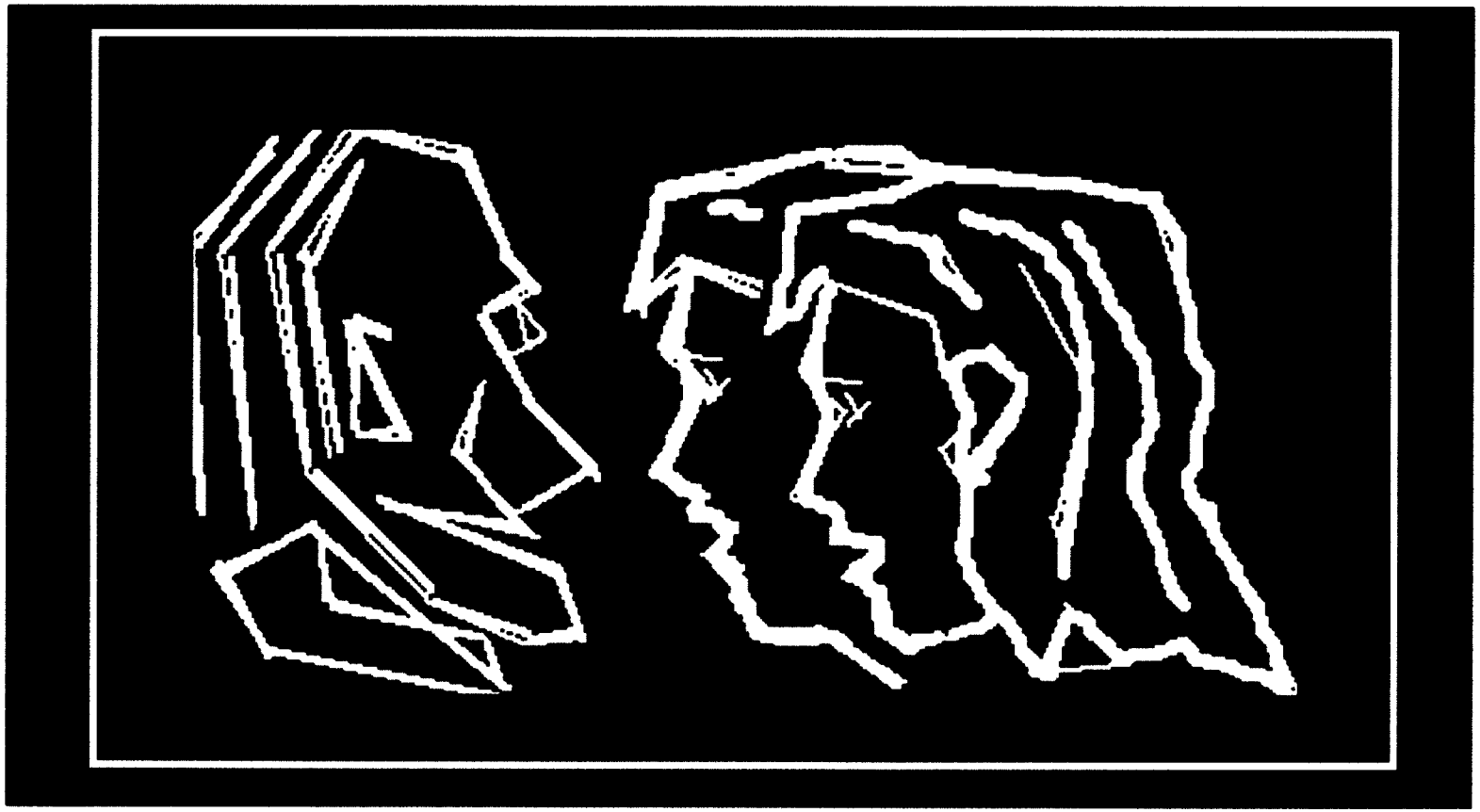
Figure 17:
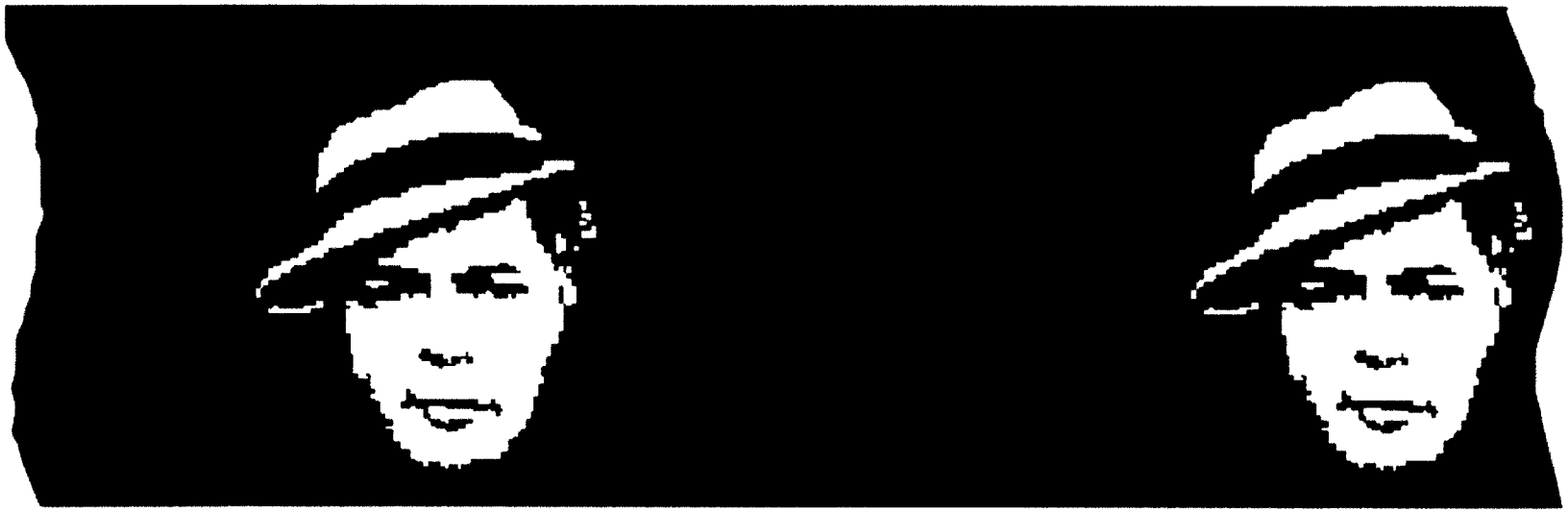

FIGS. 16 and 17 are front views of graphical images.

Figure 18:
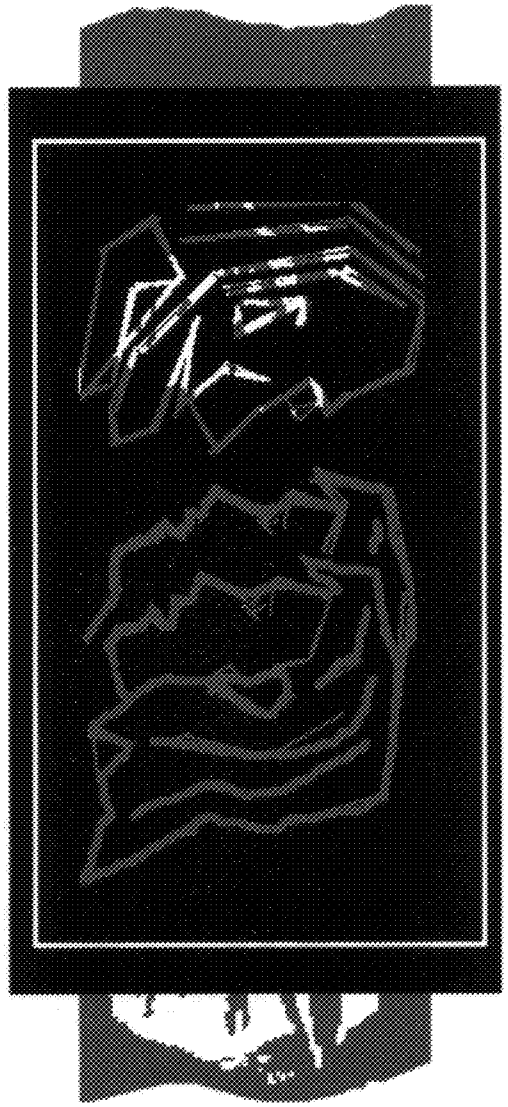

FIG. 18 is a front view of the images of FIGS. 16 and 17, superimposed.

Figure 1:
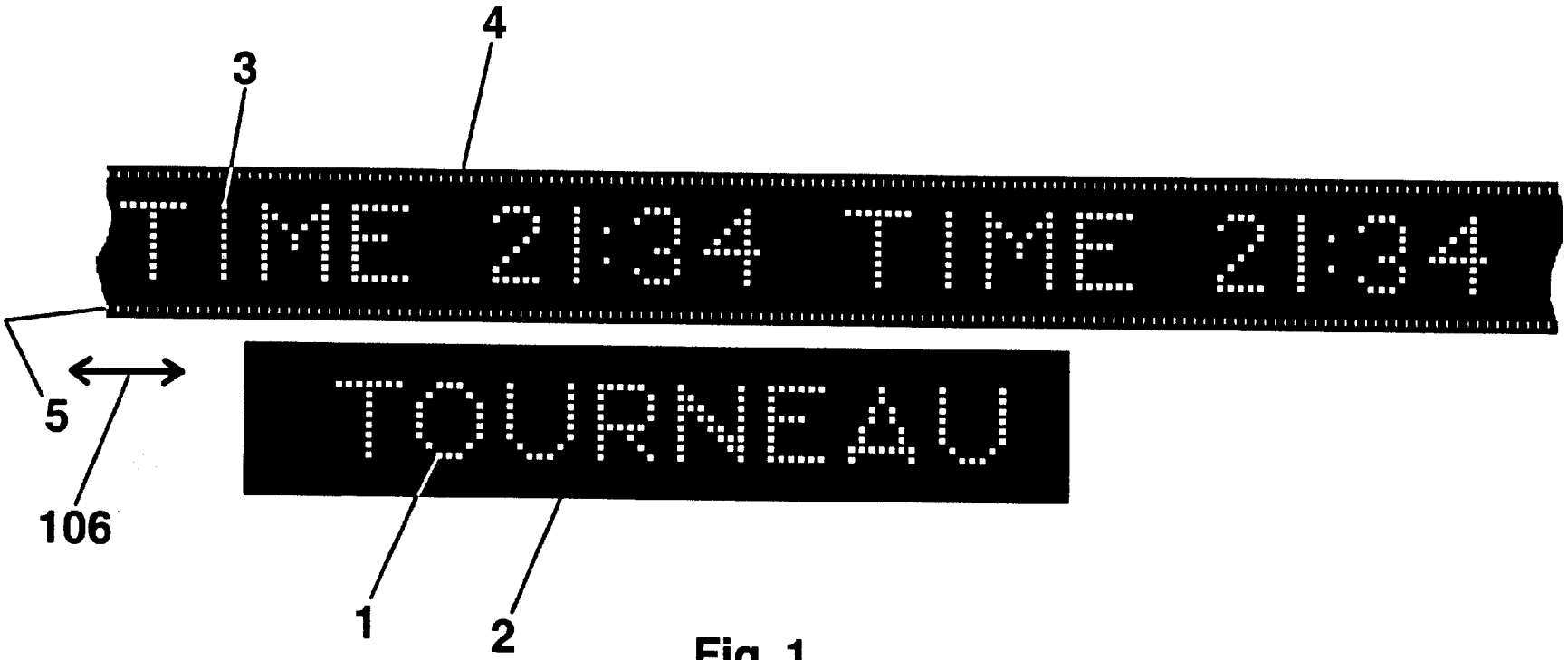

FIG. 1 shows a mask image 2 and a moving image 4 separately (not overlaid) for purposes of explanation. The mask image 2 comprises 155 little, white, square light sources 1 arranged within an implicit rectangular grid of rows and columns to spell out the name "TOURNEAU". The moving image 4 is an endlessly repeated "TIME 21:34" which is represented by little, white, squares also arranged within an implicit rectangular grid of rows and columns.

It will help the reader if he imagines the mask image 2 and the moving image 4 as captured on photographic transparencies, or as holes punched in an opaque tape, with backlighting by a broad uniform source. A series of indices 5 along the edges of the moving image 4 can be imagined as sprocket holes in a film strip, allowing the two images 2 and 4 to be moved relative to one another in directions 106 and to be accurately registered one over the other at a succession of different registration positions.

The rectangular grids and indices 5 enable one to grasp more easily how the two images may be brought into coincidence at successive points, but they are not essential to making the invention work.

Figure 2:
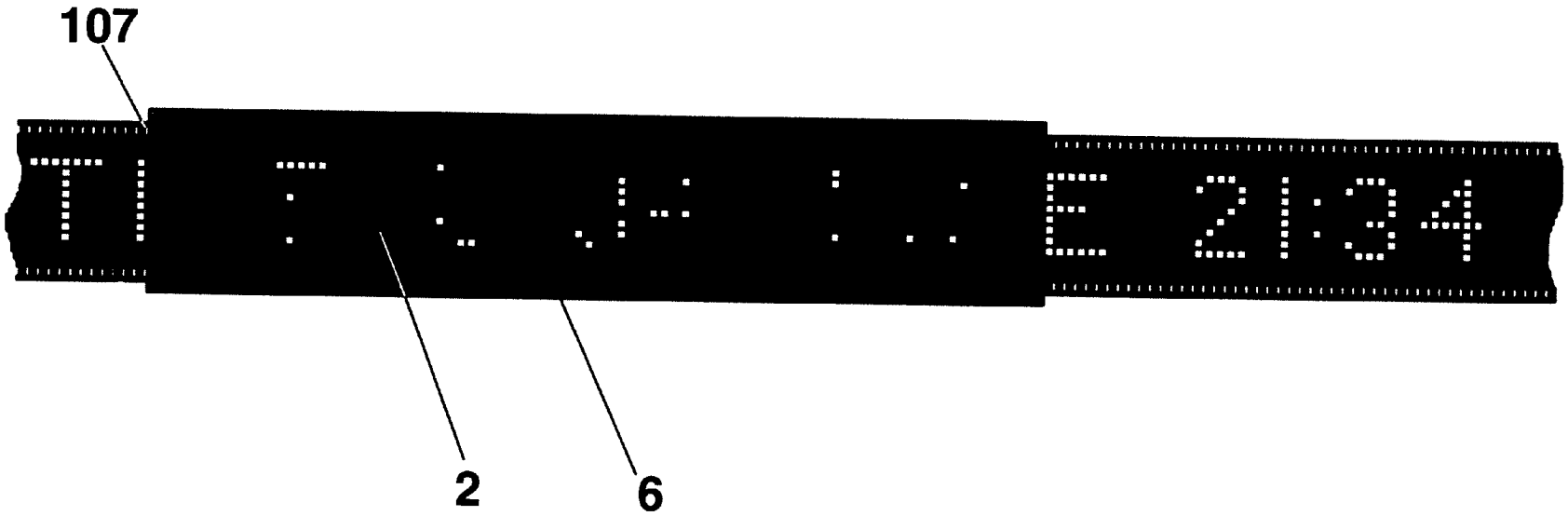
Figures 3A, 3B, 3C, 3D, 3E, 3F:
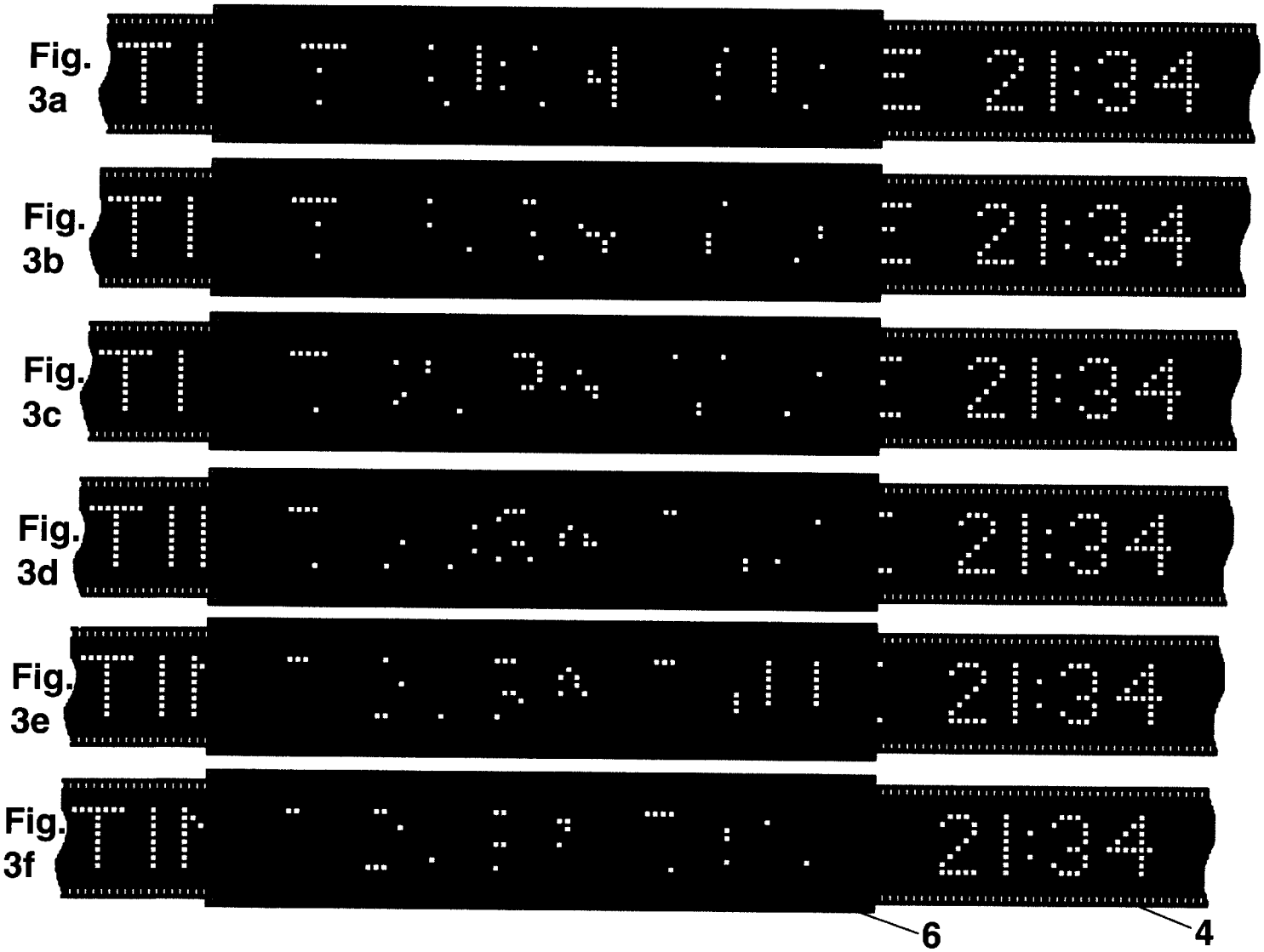

FIG. 2 shows that in operation, at a given moment, the "TOURNEAU" mask image 2 overlays the "TIME 21:34"

moving image 4 at one index point 107 (where for purposes of discussion, the left edge of the mask image 2 marks the current index point). The mask image 2 may lie either in front of or behind the moving image 4.

FIGS. 3*a* through 3*f* show the operation during a series of moments in time. Imagine the mask image 2, "TOURNEAU", as a fixed window through which the moving image 4, "TIME 21:34", is viewed as the moving image 4 passes beneath. Imagine the interior of the frame 6 as delimiting the visible portion of the device, even though the Figures show more than this (including portions to the left and right of frame 6) for purposes of explanation. Think of "TIME 21:34" as an endless loop of film strip that steps from right to left, one index mark per step, at a uniform pace.

FIG. 3*a* through 3*f* show what one would see through the "TOURNEAU" window at six successive steps. At a slow rate of stepping, neither the mask image 2 nor the moving image 4 (within the frame 6) would be recognizable because at each step the pattern of white squares gives very little information about either image. As the stepping rate increases, a rate will be reached (e.g., about 10 steps/second) where the image "TOURNEAU" on the mask image 2 becomes plainly visible to an observer whose gaze is essentially fixed on the mask image 2. This occurs because of the persistence characteristics of human vision. At this rate and at faster rates, "TOURNEAU" will remain visible. In effect, the eye and brain accumulate the small amounts of information appearing at the different steps into a sufficiently complete view of the mask image 2.

Conversely, an observer whose eyes are tracking the motion of the moving image 4, "TIME 21:34", will perceive the moving image 4 (and not the mask image 2) also because of the persistence characteristics of human vision. Consequently, one will see either "TOURNEAU" or "TIME 21:34" depending on the tracking motion (or lack of it) of one's eyes.

The eye is able to track (lock onto and follow) a moving object provided the speed of the object does not require too great an angular rate of movement of the eye. A speed of advance may be chosen that is fast enough to make "TOURNEAU" plainly visible to a stationary eye while not so fast that the required angular movement of the eye to track the moving image 4 lies beyond the eye's ability.

A broad range of speeds of advance (e.g., from about 5 steps/s to 500 steps/s) will meet this requirement depending on the circumstances. Within this range there may be a "preferred" speed that will optimize performance based on some chosen criterion. This preferred speed will depend on external conditions such as: distance from viewer to the images, which affects apparent angular rate of movement, brightness of the light source which has a direct effect on vision persistence and ambient light level, which affects background illumination and which also has a second order effect on vision persistence. Other factors described below, have an effect on visibility of the images and, hence, on the preferred speed of advance.

Figure 4:
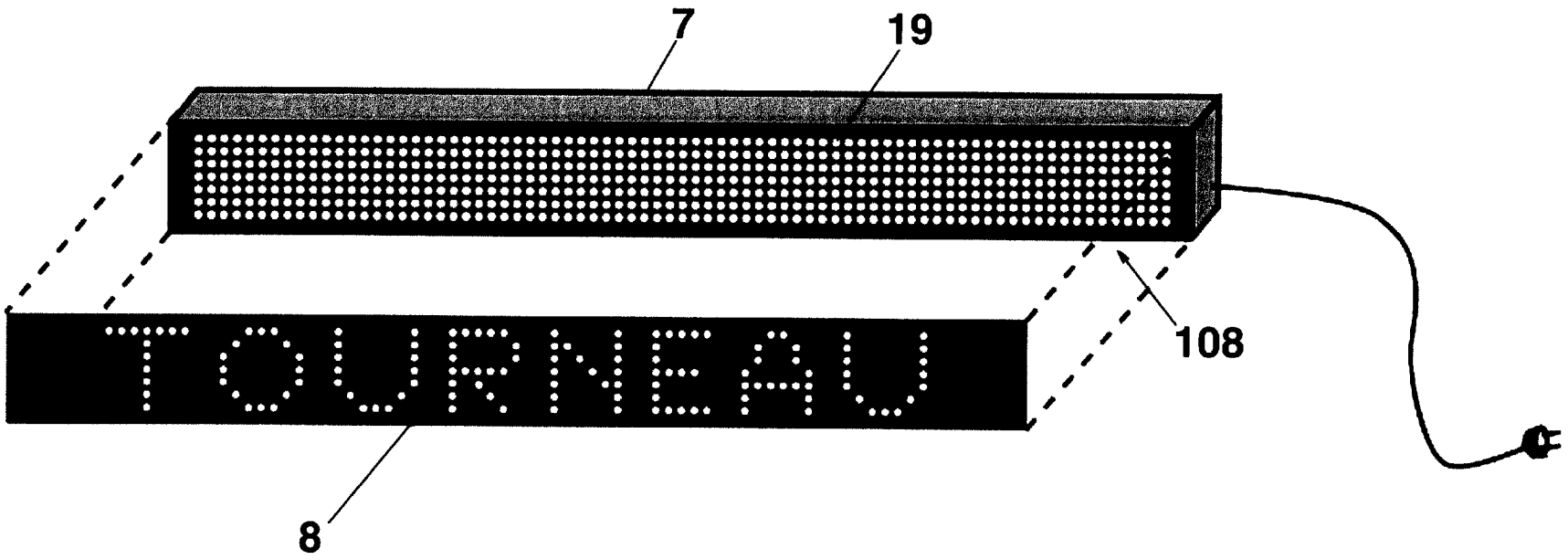
FIG. 4 is a perspective view of a traveling-message display.

FIG. 4 shows an implementation of the device which generates the moving image 4 using a commercially available traveling-message display 7 comprising a boxed array 7" high by 80" wide, of light-emitting diodes (LEDs 19) 108 arranged in a regular grid pattern and circuitry (not shown) for presenting word images that travel across the array of LEDs 19, for example, "bottom of the ninth" or "have a Coke and a smile". The mask 8 is a sheet of opaque material having in it a set of holes corresponding to the mask image 2 and conforming to the LED grid spacing pattern of the display. Alternatively, the mask 8 could be a photographic or xerographic transparency mask having transparent regions, in lieu of holes, placed in an opaque field. The mask 8 is placed over the traveling-message display 7, aligning it with the LED grid. The traveling-message display 7 is then programmed with the moving message "TIME 21:30" (the time would increment as in a digital clock). The speed of advance of the traveling-message display 7 is adjusted as necessary to achieve the effect described above.

The unused LEDs 19 of the traveling-message display 7 (in this case, the ones not part of the letters of "TOURNEAU") may be disabled in ways other than masking by the mask image 2, such as physical removal, covering with opaque paint, cutting wires, or by programming a mask into the display's controller circuitry.

Figure 5:
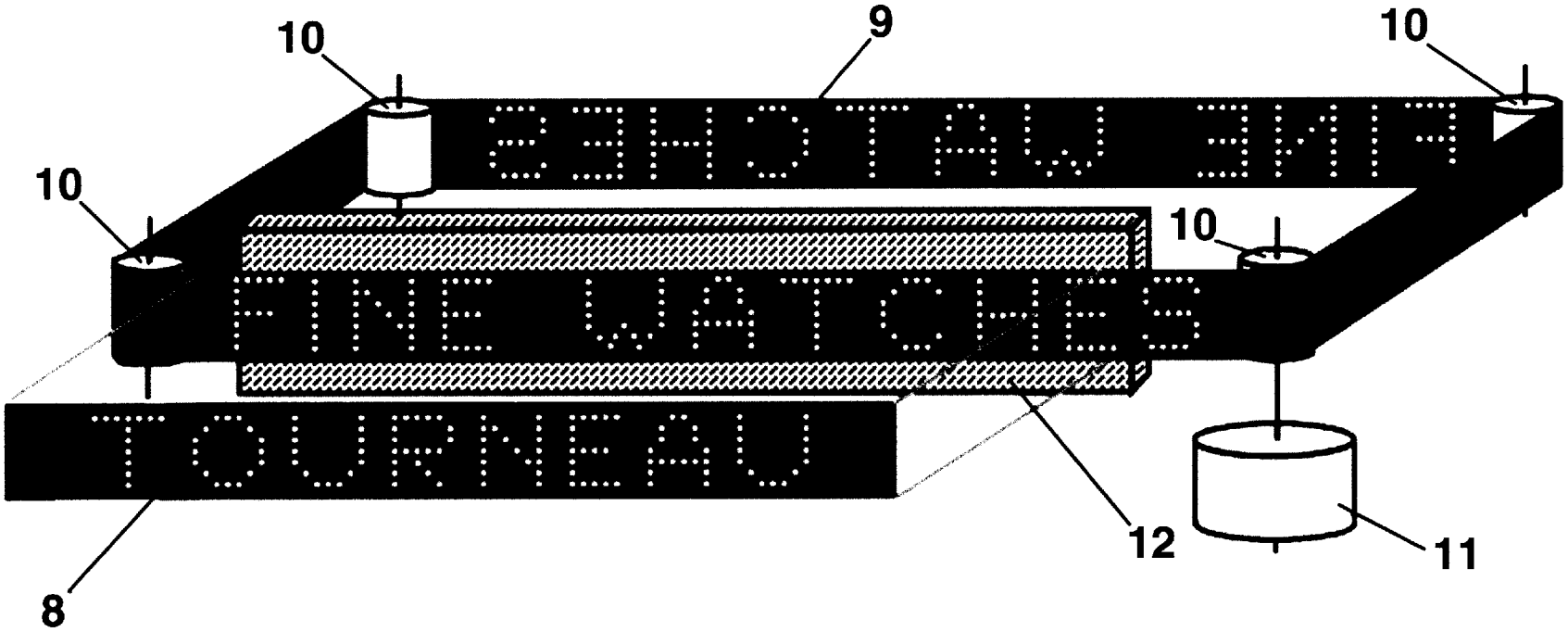
FIG. 5 is a perspective view of an implementation using a transparency moving message mask as the moving image.

FIG. 5 shows another implementation where a flexible transparency mask 9 is moved mechanically to create the moving light-source image behind the mask image 8. Mask 8 is created using one or more copies of the moving image on a strip of flexible material that is formed into a continuous belt and mounted on pulleys or sprocket rollers 10. A motor 11 connected to one of the pulleys 10 drives the belt 9 to move at a constant speed behind the mask 8. A source of uniform illumination 12 is situated behind both masks. The uniform illumination 12 may be natural outdoor light, fluorescent or incandescent or other electric lamps along with a diffuser, or any other steady light source.

Figure 6:
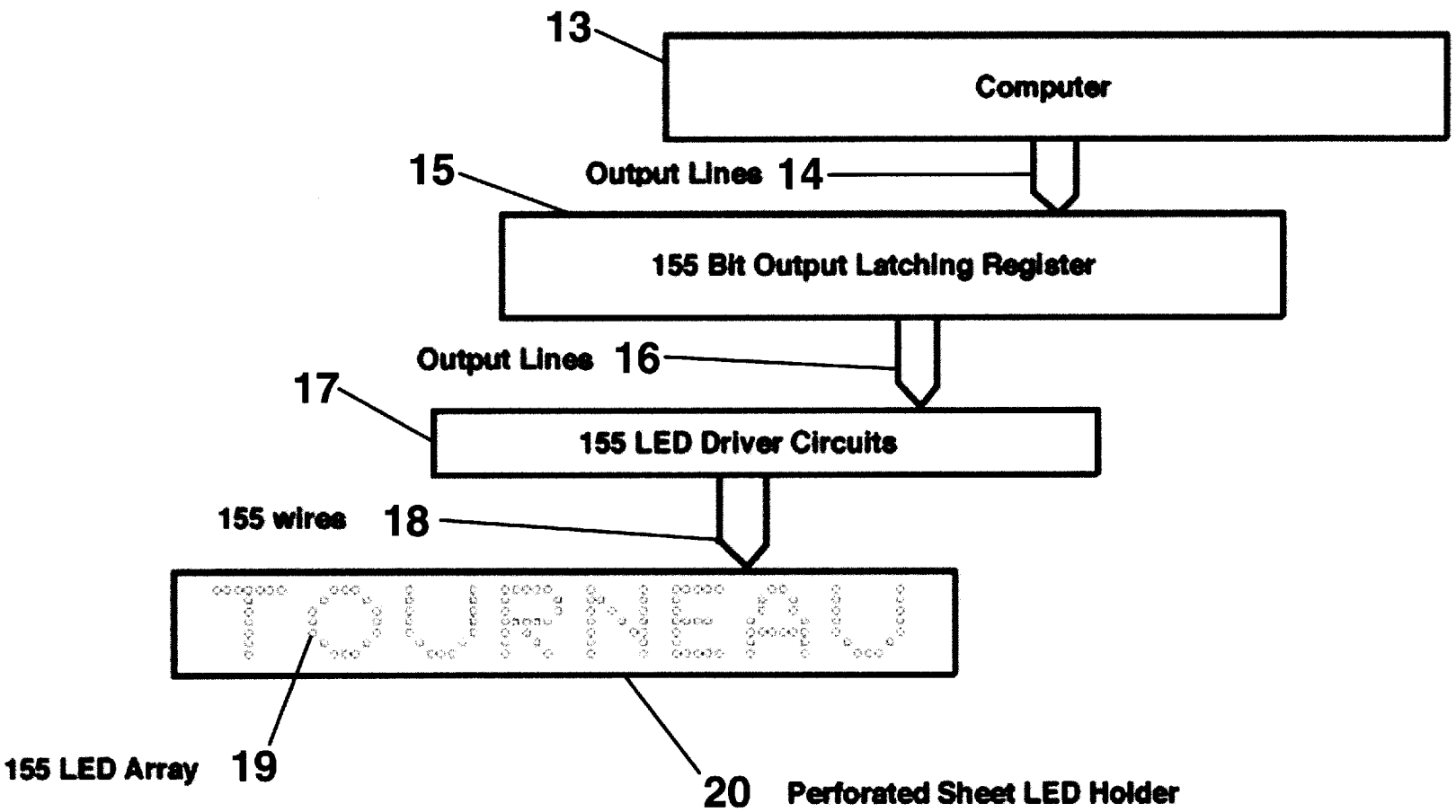
FIG. 6 is a block diagram of a computer driven-scheme.

FIG. 6 shows another implementation where both the moving image is simulated using a set of latching registers 15 and a computer 13. The computer 13 generates a time series of data words, each word having enough bytes so that there are as many bits in the word (e.g., 155) as there are output lines 14. Data on the output lines 14 are at "logic" levels and are latched at regular intervals into a latching register 15 having an equal number of logic level output lines 16. Lines 16 connect the latching register 15 to an equal number of lamp driver circuits 17. The driver circuits 17 are connected by wires 18 to an LED array 19 having as many LEDs 19 as there are computer output lines 14. The computer can be programmed to control the on/off state of each LED independently at a rate as high as several thousand times per second. In this example, the computer delivers a sequence of 155-bit wide words at regular intervals causing the LED light patterns to change in the manner depicted in FIGS. 3*a* through 3*f*.

The 155 LEDs are arrayed to form a fixed image. In the example of FIG. 6 the image is the word "TOURNEAU" again, and the arrangement is planar. The LEDs 19 could be plugged into holes drilled in a rigid sheet material 20, for example a clear plastic. The arrangement of LEDs could be three-dimensional, so that the word TOURNEAU would be seen clearly from one direction and a random pattern or another word would be seen from a perpendicular direction.

This collection of 155 LEDs 19 may be used to provide many different fixed messages by rearranging the LEDs 19 as required. For example, LEDs 19 on long flexible wires (not shown) could be endlessly rearranged when the sheet LED holder 20 contains a rectangular array of holes like a punch board. Each rearrangement would require a reprogramming of the computer.

Other light sources such as incandescent lamps may be used. The high switching speed of LEDs is not required, but the LEDs are bright, cheap, and long lived.

Figure 7:
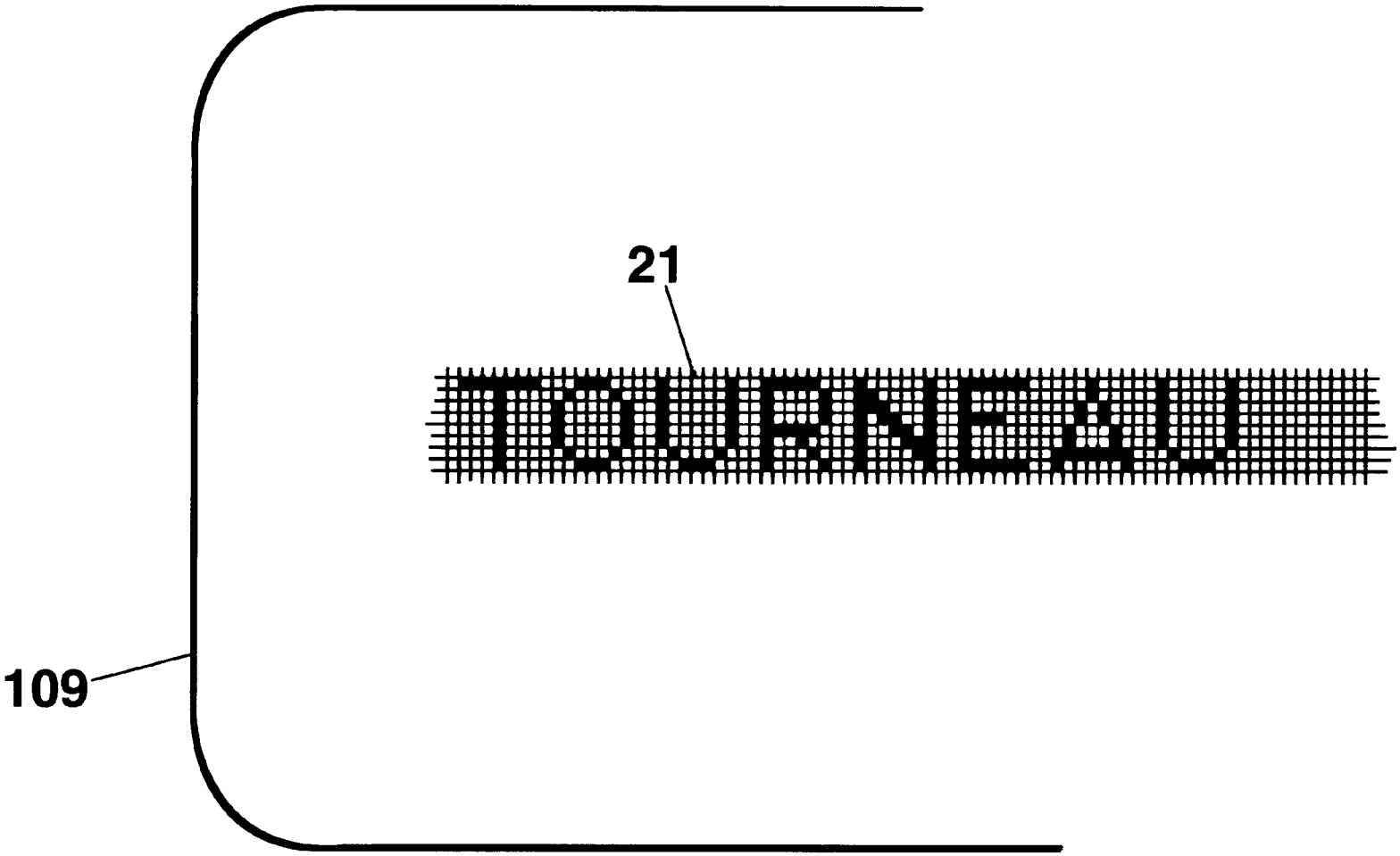
FIG. 7 is a diagram of a portion of a computer display.

FIG. 7 shows another implementation that uses only a computer to create and display the previously described effects. Instead of sending data to external LEDs, the computer displays the data as spots on the computer's monitor 109. These spots, selected to form the fixed image, are the only bright pixels on the monitor; the remainder of the monitor remains dark. Programming the computer may be done easily using available programs such as the animation program "Director 4.0" by Macromedia Inc. together with "QuickTime" by Apple Computer Corp. This implementation could be used as a "screen saver" computer program.

Returning to the LED implementations, there are many ways to program a computer or a travelling message display controller to deliver the desired light source activating signals. Consider the light sources of the fixed image to be arrayed in a 2-dimensional rectangular grid having a dimensional scale expressed in pixels, and large enough in the two dimensions to cover the area of the fixed image. To cover the image "TOURNEAU", the grid must contain a total of 8×67=536 pixels, but only 155 of these pixels correspond to actual light sources (see FIG. 7).

Each column in fixed grid 21 has 8 pixels; therefore the presence or absence of light sources in all positions of any given column can be expressed as an 8-bit binary number equivalent to one "byte" of computer data. Other examples might contain more or fewer pixels in the columns, and therefore be representable by larger or smaller binary numbers.

The occupancy status of the entire array can be represented by a set (called the FIXED data) of 67 8-bit bytes (corresponding to the 67 columns) that can be stored in the computer's memory and accessed for logical manipulation, as are the other sets of data mentioned below.

The moving image also can be represented by a set (called the MOVING data) of binary numbers. For the image of FIG. 1, 69 bytes would suffice. However, the moving image is repeated cyclically, and a short blank interval could be inserted between repeats. To include eleven blank columns, assume the MOVING data to be 80 bytes (columns) wide.

Now consider a third set of binary data (called the ACTIVE data) having the same number of bytes, 67, as the fixed image. The ACTIVE data will change from moment to moment. ACTIVE is formed, at any moment, from the logical AND of the set of 67 bytes of FIXED and a current set of 67 contiguous bytes from MOVING. At a given moment N, the first byte of FIXED will be logically ANDed to the Nth byte of MOVING and the result placed in the Nth byte of ACTIVE. The second byte of FIXED is then ANDed with the N+1st byte (modulo 80) of MOVING with the result placed in the second byte of ACTIVE, and so on for 67 times. At the end of the 67 AND operations, the 67 bytes of ACTIVE are transformed and transferred to an output register as described below. Then the 67 AND operations are repeated, beginning this time at byte N+1 (modulo 80) of the moving data. This process continues indefinitely.

155 bits (20 bytes) of OUTPUT data are needed to drive the light sources, each individual register stage being connected to a particular light source driver in accordance with a fixed wiring plan. Yet ACTIVE contains 536 bits (67 bytes) of information. The discussion below explains how the 67 ACTIVE bytes are transformed into 155 bits of OUTPUT.

Each LED location is represented within the computer by two bytes of data in accordance with its position in the grid. The rows of the grid of FIG. 7 are implicitly labeled 0 thru 7 starting at the bottom, and the columns of the grid are implicitly labeled 0 thru 66 starting at the left and increasing towards the right. The LED in column 17, row 3, for example, would be labeled by two bytes of data, the first byte being the column number and the second byte being 2^R, where R is the row number of the LED. The entire array of LEDs is described by a set of 155 of such 2-byte words in the computer memory. The content of the words corresponds with the fixed wiring plan connecting the 155 output register stages to the LED drivers. Call this data set SOURCE.

The 155 bit OUTPUT word at a given moment is created from ACTIVE for that moment and from SOURCE as follows. Examine the first byte of word #0 of SOURCE, which is the column number of the first light source. Retrieve the corresponding byte of ACTIVE and logically AND it with the second byte of word #0 of SOURCE. Store the result (1 or 0) in bit #0 of OUTPUT, which is a 155-bit wide "superword". Proceed sequentially through the 155 words of SOURCE. When finished, OUTPUT contains the current 155 bit output word. It may be directed to the output register or stored for later use. Repeat the process using ACTIVE for the next succeeding moment (modulo 80) until 80 output superwords are stored.

When the moving image is unchanging this series of computer steps need only be done one time and the resulting 80 superwords stored in the computer memory rather than dumping them into the output register. At run time, the computer need only transfer the superwords from memory to the output register at a fixed word rate.

Alternatively, for unchanging moving data, a simpler implementation may be achieved if the above processing be done "offline". In this case a set of 80 superwords, 155 bits each, is prepared as above and stored sequentially in a memory, for example an EEPROM chip. The circuitry required to drive the light sources can then be reduced to that necessary for outputting 80 155-bit words from memory in fixed cyclic sequence at a fixed timing pace. This can be done easily with a few simple circuit elements replacing the computer.

Owing to the persistence characteristics of human vision, visual images persist for about 0.1 seconds under everyday circumstances, so for good visibility of both the fixed and the moving images each LED should remain dark for no longer than 0.1 second. Good results can be achieved when a given column of lights representing the moving image traverses the fixed field in about 1 second. Broad ranges of speed both faster and slower than this that also work well.

In practice, depending on the nature of the fixed and moving images and other factors, the eye may tend to see one or the other image more easily. For this and other purposes, it may be desirable to enhance the visibility of either the fixed or the moving image.

One way to enhance the visibility of the moving image is to create a noticeable singular feature in the image that will produce a visual discontinuity such as a band of brightness (or darkness) to provide the eye with a more noticeable feature on which to concentrate, thus allowing the eye tracking to synchronize more easily with the image movement. A large block of darkness in an otherwise densely populated moving image will have the desired enhancement effect, as will a large block of brightness in a thinly populated image. If multiple colors are available (which in principle would be a simple extension of what is discussed above) putting a blob of a contrasting color into the moving image will aid eye synchronization.

Synchronization does not require conscious effort by the viewer any more than does watching a bird in flight or a tennis ball in volley. Once the mind becomes convinced there is something in motion to be seen, the involuntary tracking movements of the eyes will come into play and synchronization will be automatic. It may, in fact, require a conscious effort to stop the tracking and fixate on the other image. The trick is to provide motion clues for the mind to grasp and the eye to latch onto.

Figure 8:
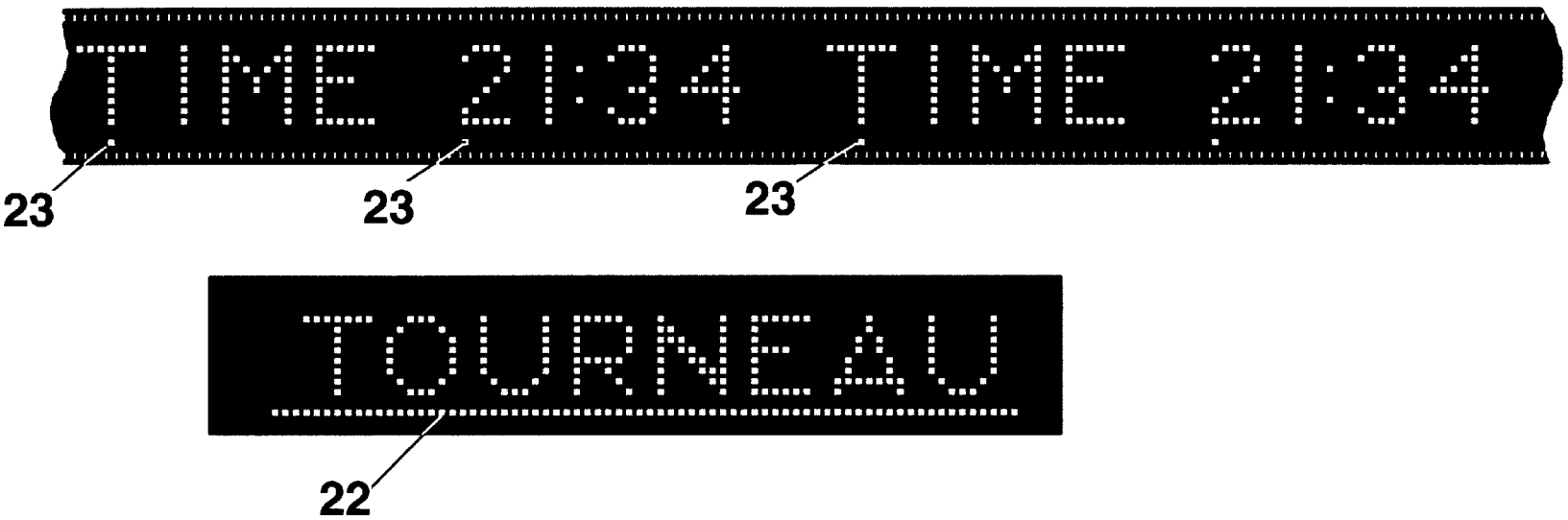
Figure 9:
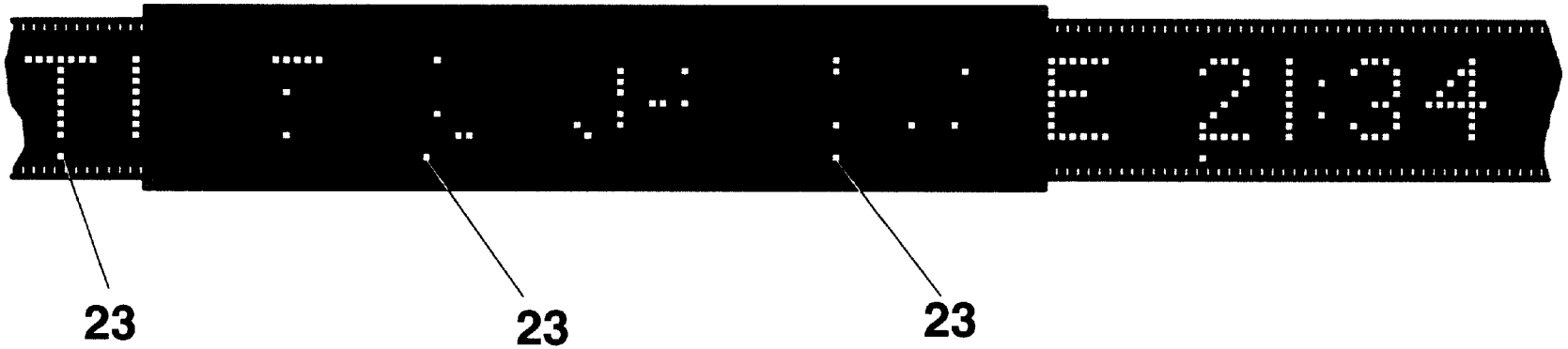
Figures 10A, 10B, 10C, 10D, 10E, 10F:
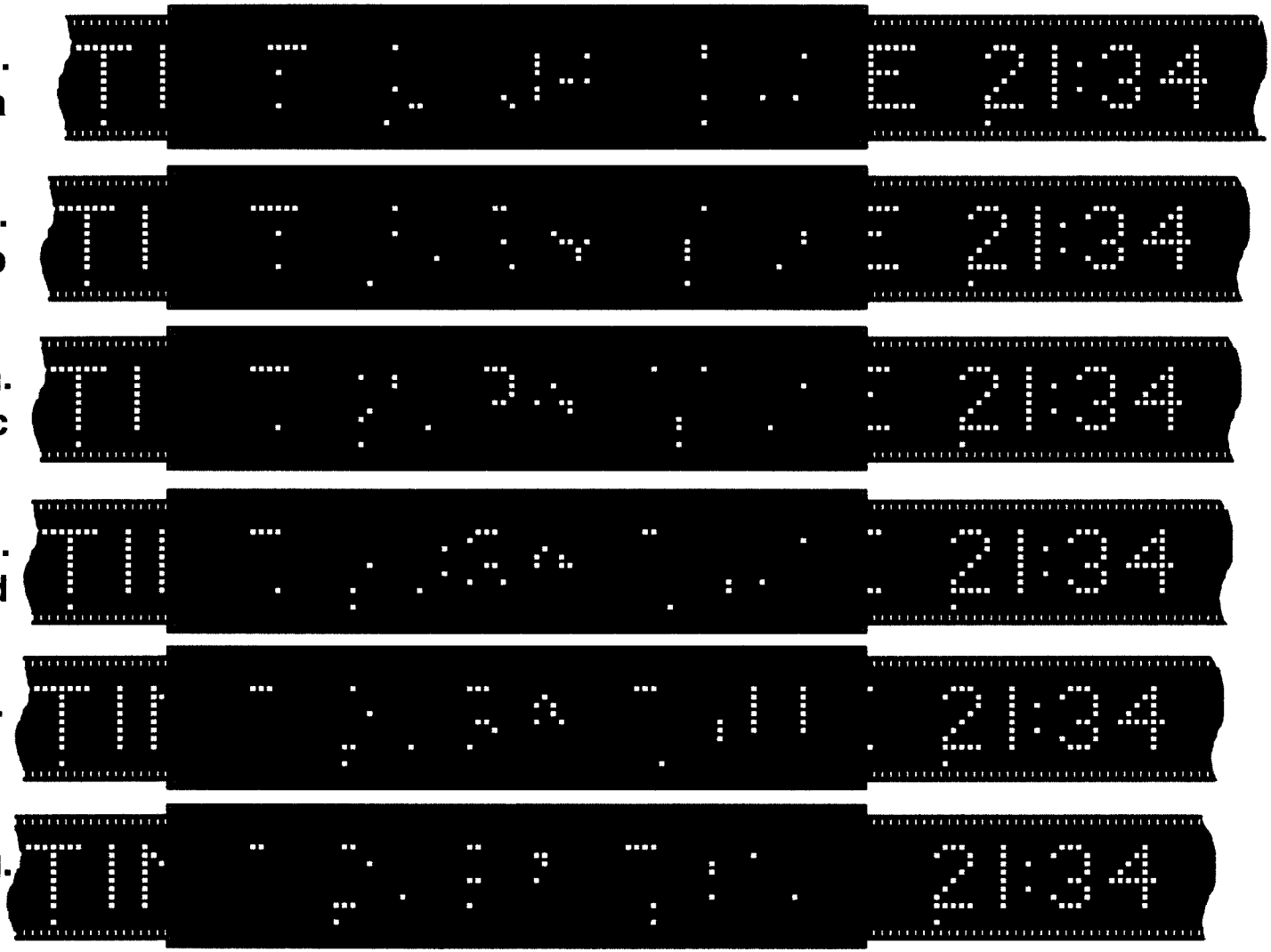

A way to provide a motion clue is shown in FIGS. 8, 9, and 10, which are like FIGS. 1, 2, and 3, with a ninth auxiliary row of light sources 22 added to the bottom edge of the mask image array. Row 22 is fully populated with light sources so that a single spot of light in this row 22 on the moving image will appear to travel smoothly without interruption across the bottom of the array as the moving image 4 traverses the field. The eye can follow this spot easily and in so doing the entire moving image 4 will come to the viewer's attention.

Other steps can be taken to affect the viewer's ability to see both the moving image and the fixed image. In cases where the moving image is too sparsely populated to illuminate the fixed image sufficiently, the moving image can be inverted, as shown in FIG. 11, exchanging ON for OFF. The inversion has the effect of producing dark letters on a light background, thus increasing the illumination of the fixed image.

Figure 12:
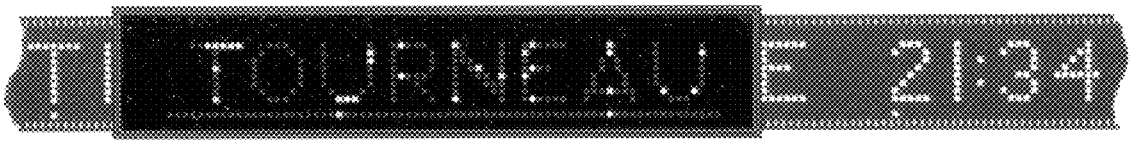
Figure 13A:
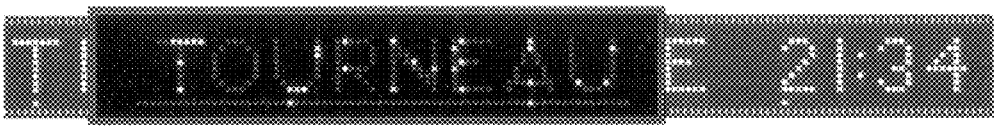
Figure 13B:
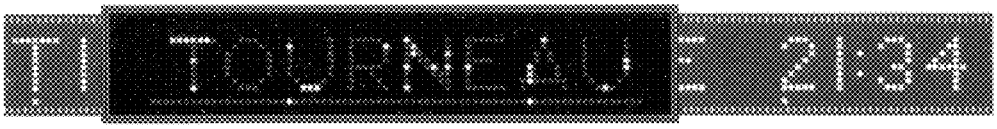
Figure 13C:
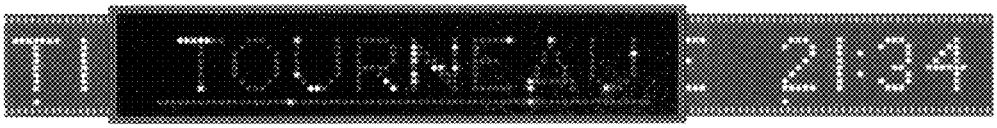
Figure 13D:
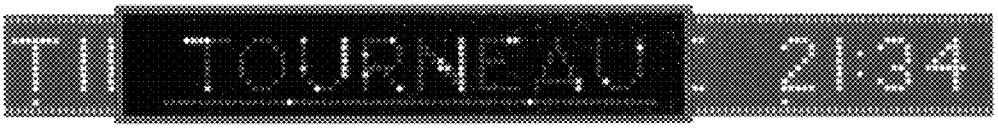
Figure 13E:
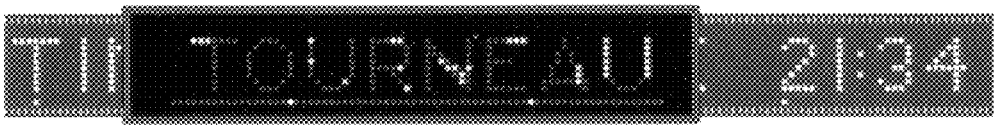
Figure 13F:
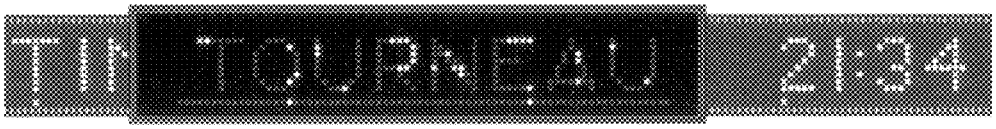

Alternatively, as seen in FIGS. 12 and 13, the light sources may be switched between two levels, BRIGHT and DIM, rather than between ON and OFF, thus continuously illuminating the fixed image at a low level. FIGS. 12 and 13 also illustrate enhancement of the moving image using the auxiliary row technique described above.

FIG. 14 shows a circuit for controlling an LED 24 between two brightness levels. With the FET (field effect transistor) 25 conducting, the desired current flows through the LED 24 and resistor A 26 giving full brightness, and with FET 25 non-conducting a reduced current flows through the LED 24 and resistor B 27, giving a reduced level of brightness. If resistor B 27 is omitted, the LED 24 will go all the way OFF.

Another method of enhancing visibility of the fixed image is to have a constant low-level background illumination in a different color, as illustrated in FIG. 15. The second color is provided by the dual-element LED 28, which has two light-producing chips of different colors within the same envelope. One color 29 is continuously ON at a reduced level of brightness, while the other color 30 is switched ON and OFF. LED elements having three or more different colors in the same envelope could also be used.

Another method for enhancing visibility of the fixed image is to outline the fixed image with a stationary border that is continuously lit from within or by external ambient light. This will give the eye a non-moving target that will aid fixation. The border 6 of FIG. 2 is an example.

By applying these visibility enhancements in reverse, other effects can be achieved. The moving image can be made very subtle so that its discovery carries with it a larger measure of astonishment and surprise. When the fixed image is a random pattern, with no recognizable image at all, the presence of the moving image becomes extremely subtle.

Other embodiments are within the scope of the claims. For example, graphic imagery could be used instead of or in addition to text imagery. With line graphics, which are in general more sparsely populated than text, care must be taken to assure the necessary refresh rate. The above image visibility enhancements also will have greater impact. FIGS. 16, 17 and FIG. 18 (which is a superposition of FIGS. 16 and 17), show an example of a pair of graphic images that has been used effectively. FIG. 16 is used as the fixed image and FIG. 17 is used as the moving image. The two brightness level method of enhancing visibility of the fixed image is depicted in this case, as evidenced by the moving image having a less-than-black background. Experimentation showed this enhancement technique to be effective. Notice that the images of FIGS. 16 and 17 are more finely pixelated than the previous examples. This would be typical of imagery prepared for use in the implementation of FIGS. 5 and 7.

The images may be combinations of text and graphics. Both of the images can be moving provided that their relative speeds enable the effects described above to occur. They could be moving in the same direction or in opposite directions. Both images could be three dimensional. The devices used to alter the ease with which the observer can perceive both images could be made controllable "on the fly" by the observer or by another party. More than two different images could be presented by similar techniques. The light source could be incandescent lights or electroluminescent panels or neon lamps.

What is claimed is:

1. Apparatus for presenting images to an observer comprising a controllable light delivery medium having a display region, and an automatic controller configured to control the light delivery medium in such a way as to enable the observer to perceive a first image only when the observer's eye is in one motion state and a second image only when the observer's eye is not in the one motion state, without relying on any change in the operation of the controller or the medium as the basis for enabling the perception of the first and second images.

2. Apparatus for presenting images to an observer, comprising a light delivery medium extending in at least two dimensions, the light delivery medium bearing a field of light delivery areas that are independently modulatable, and a device arranged to modulate the respective light delivery areas in a succession of different patterns that are presented rapidly enough to invoke the persistence capability of the observer's vision, enabling the observer to perceive a first image at the field of light delivery areas only by virtue of the persistence and the motion of the observer's eye, the field of light delivery areas being arranged so that as the different patterns are presented, a second, different image may be perceived by the observer in the same region in which the first image may be perceived.

3. The apparatus of claim 2 in which the field of light delivery areas is stationary.

4. The apparatus of claim 2 in which the device arranged to modulate the light delivery areas comprises a sheet of material on which the first image is formed.

5. The apparatus of claim 2 in which the light delivery areas are arranged on a sheet of material in the form of the second image.

6. The apparatus of claim 2 in which the first image and the second image are perceived to be in motion relative to one another.

7. The apparatus of claim 2 in which the second image is perceived to be stationary.

8. The apparatus of claim 2 in which the first image is perceived to be in motion.

9. The apparatus of claim 2 in which the first image and the second image are perceived to be in motion.

10. The apparatus of claim 2 in which the observer may perceive either the first image or the second image depending on the motion state of the observer's eye.

11. The apparatus of claim 2 in which the second image is perceived as a result of the persistence capability of the eye.

12. The apparatus of claim 2 in which the first image is not perceivable from any one of the different patterns alone.

13. The apparatus of claim 2 in which the second image is not perceivable from any one of the different patterns alone.

14. The apparatus of claim 2 in which the perception of at least one of the images depends on motion of the observer's eye to track motion of the image.

15. The apparatus of claim 2 in which the light delivery areas are also modulated in a manner to provide visual cues that aid the observer in perceiving at least one of the images.

16. The apparatus of claim 15 in which the visual cues include tracking cues that aid the observer's eye in tracking motion of one of the images.

17. The apparatus of claim 16 in which the tracking cues comprise a visual element that moves at the same rate and in close proximity to the moving image.

18. The apparatus of claim 17 in which the visual element is displayed along a border of the field.

19. The apparatus of claim 15 in which the visual cues comprise a constantly displayed element on the field of light delivery areas.

20. The apparatus of claim 19 in which the constantly displayed element comprises a frame along the border of the field.

21. The apparatus of claim 15 in which the visual cues comprise an inversion of the modulation to increase the amount of light generated by the light delivery areas for the second image.

22. The apparatus of claim 15 in which the visual cues include a region of enhanced contrast.

23. The apparatus of claim 2 in which the light delivery areas are arranged on a grid.

24. The apparatus of claim 23 in which the grid comprises a rectangular grid.

25. The apparatus of claim 23 in which the light delivery areas do not fully populate the grid.

26. The apparatus of claim 23 in which the light delivery areas are arranged on the field to represent the second image.

27. The apparatus of claim 2 in which each of the light delivery areas comprises a light source.

28. The apparatus of claim 27 in which each of the light delivery areas comprises an LED.

29. The apparatus of claim 27 in which each of the light delivery areas comprises a pixel on a computer screen.

30. The apparatus of claim 27 in which each of the light delivery areas comprises incandescent lights.

31. The apparatus of claim 27 in which each of the light delivery areas comprises electroluminescent panels.

32. The apparatus of claim 27 in which each of the light delivery areas comprises neon lamps.

33. The apparatus of claim 2 in which the device arranged to modulate the light delivery areas comprises a programmed computer.

34. The apparatus of claim 2 in which the device arranged to modulate the light delivery areas comprises a circuit.

35. The apparatus of claim 2 in which the light delivery medium comprises a traveling-message display.

36. The apparatus of claim 2 in which the light delivery areas are modulated between on and off states.

37. The apparatus of claim 2 in which the light delivery areas are modulated among more than two levels of intensity.

38. The apparatus of claim 2 in which the light deliver areas are modulated between different colors.

39. The apparatus of claim 2 in which at least one of the images includes text.

40. The apparatus of claim 2 in which at least one of the images includes a graphical element.

41. A method of presenting images to an observer on a light delivery medium extending in at least two dimensions, the light delivering medium bearing a field of light delivery areas that are independently modulatable, the method comprising modulating the respective light delivery areas in a succession of different patterns that are presented rapidly enough to invoke the persistence capability of the observer's vision, enabling the observer to perceive a first image at a region of the light delivery medium only by virtue of the persistence and the motion of the observer's eye, and arranging the field of light delivery areas so that as the different patterns are presented, a second, different image may be perceived by the observer in the same region in which the first image is perceived.

42. The method of claim 41 in which the field of light delivery areas is held stationary.

43. The method of claim 41 in which the light delivery areas are modulated between on and off states.

44. The method of claim 41 in which the light delivery areas are modulated among more than two levels of intensity.

45. The method of claim 41 in which the light deliver areas are modulated between different colors.

46. The method of claim 41 in which the light delivery areas are also modulated in a manner to provide visual cues that aid the observer in perceiving at least one of the images.

47. Apparatus for presenting images to an observer, comprising a light delivery medium bearing a stationary two-dimensional field of light delivery areas that are independently modulatable, the light delivery areas populating fewer than all of the possible positions in a rectangular grid of positions, and a device arranged to modulate the respective light delivery areas in a succession of different patterns that are presented rapidly enough to invoke the persistence capability of the observer's vision, enabling the observer to perceive a first moving image at a region of the light delivery medium, the field of light delivery areas being arranged so that as the different patterns are presented, a second, different, static image may be perceived by the observer in the same region in which the first image is perceived, neither of the images being easily perceived from any of the patterns taken alone.

48. A medium on which is stored a computer program that is arranged to cause a processor to control a light delivery medium having a display region in such a way as to enable an observer to perceive a first image only when the observer's eye is in one motion state and a second image only when the observer's eye is not in the one motion state, without relying on any change in the flow of the computer program or the medium as the basis for enabling the perception of the first and second images.

49. Apparatus for presenting images to an observer comprising a means for controllable light delivery, the means having a display region, and a means for automatically controlling the light delivery medium in such a way as to enable the observer to perceive a first image only when the observer's eye is in one motion state and a second image only when the observer's eye is not in the one motion state, without relying on any change in the operation of the controller or the medium as the basis for enabling the perception of the first and second images.

* * * * *